United States Patent [19]

Favilli et al.

[11] 3,977,292

[45] Aug. 31, 1976

[54] FIGURE TOY HAVING TUNED SOUND PRODUCERS AND INDICIA

[75] Inventors: Riccardo Aldo Favilli, Redondo Beach; J. Stephen Lewis, Pacific Palisades; Alfonso Fred Ratcliffe, Los Angeles, all of Calif.

[73] Assignee: Mattel, Inc., Hawthorne, Calif.

[22] Filed: Dec. 30, 1974

[21] Appl. No.: 537,293

[52] U.S. Cl. ..... 84/470; 46/117; 46/175 R; 84/375

[51] Int. Cl.[2] ..... G09B 15/00; A63H 5/00

[58] Field of Search ..... 84/470, 375; 46/117, 46/175 R, 180

[56] References Cited

UNITED STATES PATENTS

| | | | |
|---|---|---|---|
| 672,678 | 4/1901 | Kitching | 84/470 |
| 1,309,915 | 7/1919 | Siegel | 84/470 |
| 1,310,205 | 7/1919 | Morgenstern | 46/117 |
| 1,571,868 | 2/1926 | Parsons | 46/117 |
| 2,160,756 | 5/1939 | Schreck | 36/2.5 |
| 2,721,420 | 10/1955 | Chatten | 46/175 R |
| 2,879,685 | 3/1959 | Page | 84/470 |
| 2,988,848 | 6/1961 | Lemelson | 46/180 |
| 3,595,121 | 7/1971 | Magers | 84/470 |

*Primary Examiner*—Stephen J. Tomsky
*Attorney, Agent, or Firm*—Stephen L. King; Max E. Shirk; Robert W. Mulcahy

[57] ABSTRACT

Tuned reed-type sound producers are mounted in different parts of a figure toy and are identified by indicia so that different tones may be produced in a predetermined sequence by depressing the indicia. The sound producers may produce musical notes, vowels or the like.

6 Claims, 5 Drawing Figures

FIG. 1
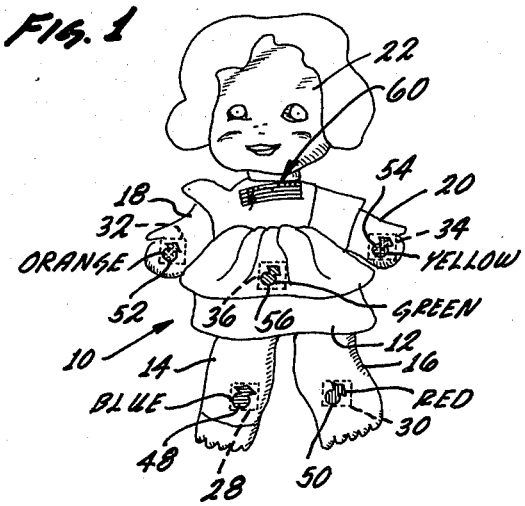
FIG. 2
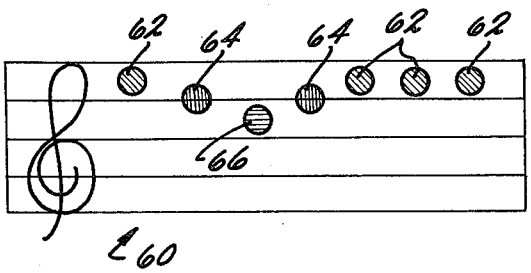
FIG. 3
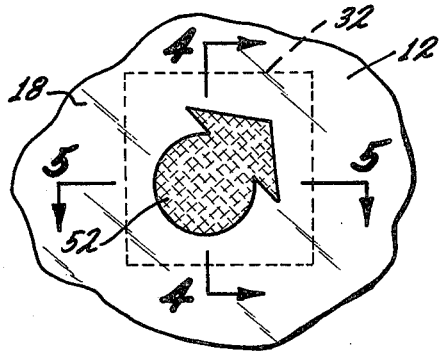
FIG. 4
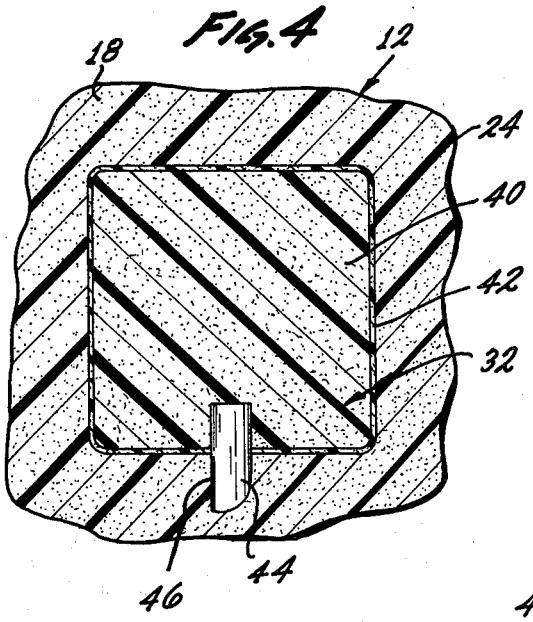
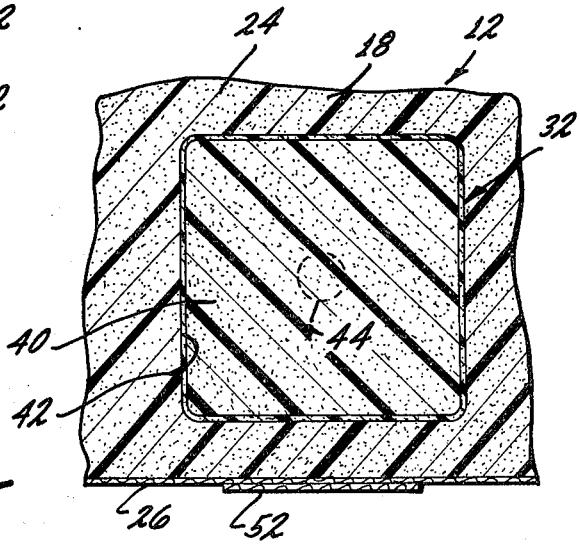
FIG. 5

FIGURE TOY HAVING TUNED SOUND PRODUCERS AND INDICIA

BACKGROUND OF THE INVENTION

The background of the invention will be set forth in two parts.

1. Field of the Invention

The present invention pertains generally to the field of figure toys and more particularly to a figure toy having tuned reed-type sound producers and a different indicium identifying each sound producer so that different tones may be produced in a predetermined sequence.

2. Description of the Prior Art

The prior art known to applicant is listed by way of illustration, but not of limitation, in separate communications to the United States Patent Office.

The present invention exemplifies improvements over this prior art.

For example, U. S. Pat. No. 1,310,205 discloses an animal toy in the form of a bear having a filling of a yielding material covered by a flexible covering of plush so that the toy will yield to pressure. A bellows-actuated, reed-type sound producer is mounted in each ear of the toy for producing a sound when pressure is applied to each ear for collapsing the bellows mounted therein. The sound producers may be substantially identical or of different tones. However, the animal toy does not include indicia or the like for identifying the tone to be produced by a particular sound producer.

SUMMARY OF THE INVENTION

It is an object of the present invention to provide a new and useful figure toy having tuned sound producers and indicia.

It is another object of the present invention to provide a figure toy which includes means for playing musical notes in a predetermined sequence by depressing different colored indicia provided on the figure toy.

According to the present invention, a figure toy having a body and appendages made of a compressible material covered with a flexible covering is provided with air-actuated reed-type sound producers. The sound producers are tuned so that each one produces a different tone when the figure toy is compressed in the vicinity of a particular sound producer. The sound producers are identified by colored indicia provided on the exterior surface of the flexible covering adjacent the sound producers. The indicia may be depressed in a predetermined sequence to produce predetermined vowel sounds, musical notes or the like.

The figure toy may be filled with a soft polymeric foam and the air chambers for the reed-type sound producers may be made from the same material which is covered with an impervious covering to form a collapsible air chamber.

Additional colored indicia, corresponding to the indicia adjacent the sound producers, may be provided on a musical scale on the figure toy for defining a particular melody to be played by depressing selected ones of the indicia adjacent the sound producers.

The features of the present invention which are believed to be novel are set forth with particularity in the appended claims. The present invention, both as to its organization and manner of operation, together with further objects and advantages thereof may best be understood by reference to the following description, taken in connection with the accompanying drawings in which like reference characters refer to like elements in the several views.

BRIEF DESCRIPTION OF THE DRAWINGS

FIG. 1 is an elevational view of a figure toy constituting a presently preferred embodiment of the invention;

FIG. 2 is an enlarged plan view of the musical scale shown on the figure toy in FIG. 1;

FIG. 3 is an enlarged, partial plan view of an indicium shown on the figure toy of FIG. 1;

FIG. 4 is an enlarged cross-sectional view taken along line 4—4 of FIG. 3; and FIG. 5 is an enlarged cross-sectional view taken along line 5—5 of FIG. 3.

DESCRIPTION OF THE PREFERRED EMBODIMENT

Referring again to the drawing, a figure toy constituting a presently preferred embodiment of the invention, generally designated 10, includes a body 12 to which a plurality of appendages 14, 16, 18, 20 and 22 are affixed. The figure toy 10 may be in the form of an animal or, alternatively, in the form of a doll and is shown herein for purposes of illustration, but not of limitation, as being in the form of a doll wherein the appendages 14, 16 are legs, the appendages 18, 20 are arms and the appendage 22 is a head.

The body and the appendages may be filled with a suitable soft, compressible material, such as a foamed polymeric material, indicated generally at 24. This material may be covered with a flexible, plush cloth covering 26 of well-known type.

Figure toy 10 may also be provided with a plurality of air-actuated, reed-type sound producers 28, 30, 32, 34 and 36. Each sound producer includes an air reservoir 40 which may be made from the same polymeric material as the filler 24. In this event, however, the polymeric material must be covered with an impervious, flexible covering 42 which may be made from light latex, or the like, and which secures a reed-type sound producer 44 in fluid communication with air chamber 40 at one end thereof. Each sound producer 44 includes a reed 46 which may be tuned in accordance with prior-art practices to produce a different musical note, vowel sound or the like.

Figure toy 10 also includes a plurality of indicia 48, 50, 52, 54 and 56. Each indicium may be affixed to flexible covering 26 adjacent an associated one of the sound producers and may be given a different color to identify the particular tone produced by a particular sound producer.

As will be apparent to those skilled in the art, a simple instruction book may be prepared to produce either music or intelligent vowel sounds by depressing the indicia in a predetermined sequence.

Alternatively, a musical scale 60 may be displayed on figure toy 10 and may have indicia 62, 64 and 66 displayed thereon in a predetermined sequence which defines a particular melody to be played by depressing corresponding indicia adjacent associated ones of the sound producers. In this event, the sound producers will be tuned to produce musical notes varying in pitch and having a recognizable musical shape.

It will also be appreciated by those skilled in the art that the play-value of figure toy 10 is enhanced by making the air chamber 40 of the same soft, flexible material as the filling 24 so that a child-user does not notice a substantial difference in the texture and feel of figure toy 10 when the indicia are depressed or when figure toy 10 is otherwise manipulated.

While the particular figure toy herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of same.

What is claimed is:

1. In a figure toy of the type having a body and appendages made from a soft, foamed Polymeric material, the improvement which comprises:

a plurality of reed-type sound producers mounted in said soft, foamed Polymeric material in at least one of said body and said appendages, each of said reed-type sound producers including means for producing a tone differing from the tone produced by any of the other sound producers in said figure toy;

a flexible, impervious cover placing a portion of said Polymeric material in fluid communication with each sound producer to provide an air chamber therefor ; and indicia means on said figure toy for identifying the sound produced by each sound producer, whereby said sound producers may be actuated in a predetermined sequence to produce intelligence.

2. An improvement as stated in claim 1 wherein said sound producers each produce a different vowel sound.

3. An improvement as stated in claim 1 wherein each of said sound producers produces a different musical note.

4. An improvement as stated in claim 1 wherein said indicia means includes an indicium for each sound producer, each of said indicium being of a different color.

5. An improvement as stated in claim 4 wherein an indicium is placed on said figure toy adjacent each sound producer.

6. An improvement as stated in claim 5 including additional colored indicia provided on a musical scale on said figure toy for defining a particular melody to be played by depressing selected ones of said colored indicia adjacent said sound producers, the colors used for said indicia on said musical scale corresponding to the colors used for said indicia identifying said sound producers, whereby said indicia on said musical scale comprise instructions for playing said melody.

* * * * *